US011017704B1

(12) United States Patent
Ha et al.

(10) Patent No.: US 11,017,704 B1
(45) Date of Patent: May 25, 2021

(54) DISPLAY DEVICE CAPABLE OF DISPLAYING 3D IMAGE

(71) Applicant: Samsung Display Co., Ltd., Yongin-Si (KR)

(72) Inventors: Youngsang Ha, Suwon-si (KR); Rangkyun Mok, Seoul (KR); Jiwon Lee, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/933,040

(22) Filed: Jul. 20, 2020

(30) Foreign Application Priority Data

Nov. 5, 2019 (KR) ..... 10-2019-0140480

(51) Int. Cl.
*G09G 3/00* (2006.01)

(52) U.S. Cl.
CPC ..... *G09G 3/007* (2013.01); *G09G 3/003* (2013.01); *G09G 2300/023* (2013.01); *G09G 2330/021* (2013.01)

(58) Field of Classification Search
CPC .. G09G 3/007; G09G 3/003; G09G 2300/023; G09G 2330/021; G09G 5/377; G02B 30/27; G02F 1/29; H04N 13/31; H04N 13/305
See application file for complete search history.

(56) References Cited

U.S. PATENT DOCUMENTS

| | | | | |
|---|---|---|---|---|
| 8,189,129 | B2 | 5/2012 | Eichenlaub | |
| 2010/0118218 | A1* | 5/2010 | Eichenlaub | G09G 3/003 349/15 |
| 2011/0013286 | A1* | 1/2011 | Chen | G09G 5/377 359/619 |
| 2012/0050857 | A1* | 3/2012 | Lee | H04N 13/31 359/464 |
| 2013/0053100 | A1* | 2/2013 | Song | G09G 3/003 455/556.1 |
| 2014/0313173 | A1* | 10/2014 | Chen | H04N 13/305 345/204 |
| 2014/0340292 | A1* | 11/2014 | Kashiwagi | G02B 30/27 345/87 |
| 2015/0219912 | A1* | 8/2015 | Kashiwagi | G02F 1/29 349/15 |

FOREIGN PATENT DOCUMENTS

| | | | |
|---|---|---|---|
| KR | 100696657 | B1 | 3/2007 |
| KR | 101540641 | B1 | 7/2015 |
| KR | 101800897 | B1 | 11/2017 |
| KR | 101951297 | B1 | 2/2019 |

* cited by examiner

*Primary Examiner* — Richard J Hong
(74) *Attorney, Agent, or Firm* — Cantor Colburn LLP

(57) ABSTRACT

A display device includes a display panel which displays an image according to an image display mode including a first display mode and a second display mode and includes a surface on which the image is displayed, a rollable lens including a first lens array and a second lens array spaced apart from the first lens array, and a roller disposed inside the rollable lens. Here, the roller rotates the rollable lens so that the first lens array is disposed on a surface of the display panel in the first display mode, and the roller rotates the rollable lens so that the second lens array is disposed on the surface of the display panel in the second display mode.

20 Claims, 16 Drawing Sheets

DISPLAY DEVICE CAPABLE OF DISPLAYING 3D IMAGE

This application claims priority to Korean Patent Application No. 10-2019-0140480, filed on Nov. 5, 2019, and all the benefits accruing therefrom under 35 U.S.C. § 119, the content of which in its entirety is herein incorporated by reference.

BACKGROUND

1. Field

Exemplary embodiments of the invention herein relate to a display device capable of displaying a three-dimensional image.

2. Description of Related Art

A three-dimensional ("3D") display technology has been applied to various image display fields such as movies, televisions, and mobile phones. The 3D display has an ultimate goal of allowing humans to feel a 3D effect as same as experience in a real-world environment. To this end, technologies including a stereo method and a multi-view method have been researched. Among the technologies, a light field method may reproduce further exact 3D spatial information.

Light generated from a display panel may pass through a lens to provide a light field. In recent years, researches for varying an arrangement method of lenses (e.g., inclination) have been performed to improve a display quality of a 3D image.

In recent years, mobile devices including a display device, such as mobile phones, personal digital assistants ("PDA"), navigation units for vehicles, tablet computers, and game consoles, have been widely used. The mobile devices may display images appropriately to a screen direction, e.g., when the screen direction is changed from a horizontal (transverse) direction to a vertical (perpendicular) direction or from the vertical direction to the horizontal direction.

Also, a recent demand for watching the 3D image in the mobile devices has increased, and the display device capable of providing a two-dimensional ("2D") image even when the screen direction is changed is desired.

SUMMARY

Exemplary embodiments of the invention provide a display device capable of displaying a three-dimensional ("3D") image when a screen direction of the display device is changed.

An exemplary embodiment of the invention provides a display device including a display panel which displays an image according to an image display mode including a first display mode and a second display mode and includes a surface on which the image is displayed, a rollable lens including a first lens array and a second lens array spaced apart from the first lens array, and a roller disposed inside the rollable lens. Here, the roller rotates the rollable lens so that the first lens array is disposed on a surface of the display panel in the first display mode, and the roller rotates the rollable lens so that the second lens array is disposed on the surface of the display panel in the second display mode.

In an exemplary embodiment, the first display mode may output the image in a vertical direction of the display panel, and the second display mode may output the image in a horizontal direction of the display panel.

In an exemplary embodiment, the first lens array may include a plurality of first lens units arranged in a first direction, and the second lens array may include a plurality of second lens units arranged in a second direction crossing the first direction.

In an exemplary embodiment, the plurality of first lens units may have a shape inclined at a first inclination angle with respect to a virtual first reference line parallel to the second direction, and the plurality of second lens units may have a shape inclined at a second inclination angle with respect to a virtual second reference line parallel to the first direction.

In an exemplary embodiment, each of the plurality of first lens units and the plurality of second lens units may include a lenticular lens.

In an exemplary embodiment, the first inclination angle may be different from the second inclination angle.

In an exemplary embodiment, the roller may include a first roller and a second roller, which are spaced apart from each other in the first direction.

In an exemplary embodiment, the first roller and the second roller may move the rollable lens in a first rotation direction so that the first lens array is disposed on the surface of the display panel when the image display mode of the display panel is switched from the second display mode to the first display mode, and the first roller and the second roller may move the rollable lens in a second rotation direction different from the first rotation direction so that the second lens array is disposed on the surface of the display panel when the image display mode of the display panel is switched from the first display mode to the second display mode.

In an exemplary embodiment, the first roller and the second roller may be disposed in correspondence to long sides of the display panel, respectively.

In an exemplary embodiment, the first roller and the second roller may be disposed in correspondence to short sides of the display panel, respectively.

In an exemplary embodiment, a size of each of the first lens array and the second lens array may be greater than or equal to a size of the display panel.

In an exemplary embodiment, the display device may further include a window module corresponding to the surface of the display panel and disposed on the rollable lens.

In an exemplary embodiment, the display device may further include a case which accommodates the rollable lens, the display panel, a first roller, and a second roller.

In an exemplary embodiment of the invention, a display device includes a display panel which displays an image, a case which accommodates the display panel, a first lens panel attached to a first side of the case, and a second lens panel attached to a second side of the case. Here, the first lens panel includes a first lens array including a plurality of first lens units arranged in a first direction, and the second lens panel includes a second lens array including a plurality of second lens units arranged in a second direction.

In an exemplary embodiment, the display device may further include a first connection part which connects the case with the first lens panel, and a second connection part which connects the case with the second lens panel.

In an exemplary embodiment, each of the first connection part and the second connection part may include a flexible material.

In an exemplary embodiment, the plurality of first lens units may have a shape inclined at a first inclination angle with respect to a virtual first reference line parallel to the second direction, and the plurality of second lens units may have a shape inclined at a second inclination angle with respect to a virtual second reference line parallel to the first direction.

In an exemplary embodiment, the first inclination angle may be different from the second inclination angle.

In an exemplary embodiment, each of the plurality of first lens units and the plurality of second lens units may include a lenticular lens.

In an exemplary embodiment, the display device may further include a window module attached to a third side of the case.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain principles of the invention. In the drawings.

DETAILED DESCRIPTION

Figure 1:
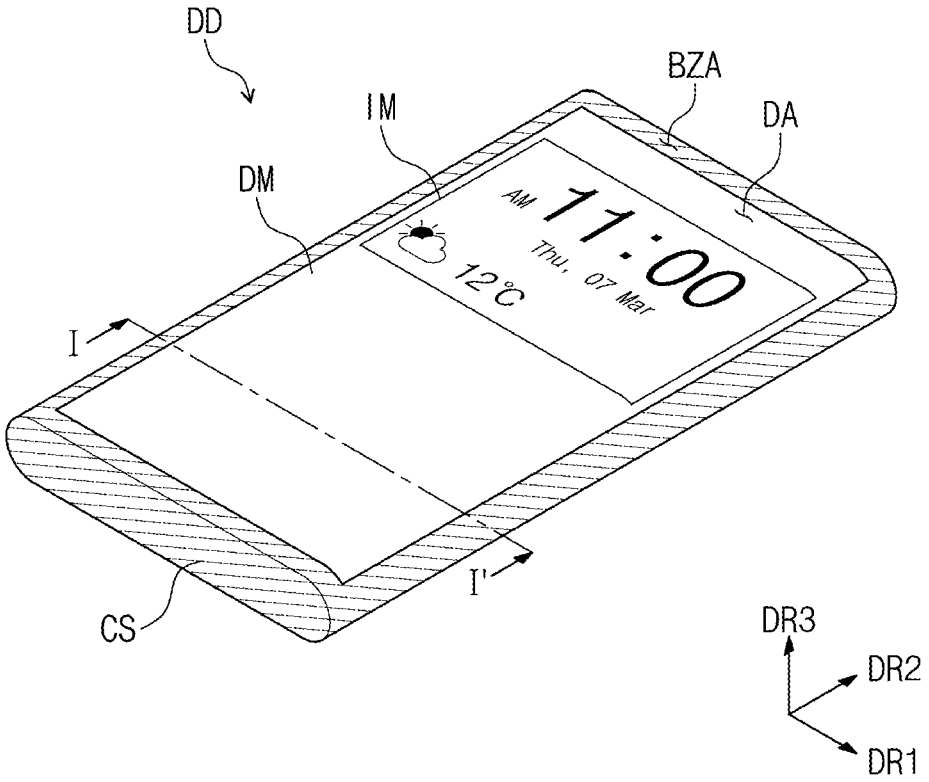
FIG. 1 is a perspective view illustrating an exemplary embodiment of a display device according to the invention.

In this specification, it will also be understood that when one component (or region, layer, portion) is referred to as being 'on', 'connected to', or 'coupled to' another component, it can be directly disposed/connected/coupled on/to the one component, or an intervening third component may also be present.

Like reference numerals refer to like elements throughout. Also, in the drawing figures, the thickness, ratio, and dimensions of components are exaggerated for clarity of illustration. The term "and/or" includes any and all combinations of one or more of the associated listed items.

It will be understood that although the terms such as 'first' and 'second' are used herein to describe various elements, these elements should not be limited by these terms. The terms are only used to distinguish one component from other components. For example, a first element referred to as a first element in one embodiment can be referred to as a second element in another exemplary embodiment without departing from the scope of the appended claims. The terms of a singular form may include plural forms unless referred to the contrary.

Also, spatially relative terms, such as "below", "lower", "above", and "upper", may be used herein for ease of description to describe an element and/or a feature's relationship to another element(s) and/or feature(s) as illustrated in the drawings. The terms may be a relative concept and described based on directions expressed in the drawings.

The meaning of 'include' or 'comprise' specifies a property, a fixed number, a step, an operation, an element, a component or a combination thereof, but does not exclude other properties, fixed numbers, steps, operations, elements, components or combinations thereof.

Unless otherwise defined, all terms (including technical and scientific terms) used herein have the same meaning as generally understood by those skilled in the art. Terms as defined in a commonly used dictionary should be construed as having the same meaning as in an associated technical context, and unless defined apparently in the description, the terms are not ideally or excessively construed as having formal meaning.

Hereinafter, embodiments of the invention will be described with reference to the accompanying drawings.

FIG. 1 is a perspective view illustrating an exemplary embodiment of a display device according to the invention.

Referring to FIG. 1, a display device DD in an exemplary embodiment of the invention may include a display module DM and a case CS accommodating the display module DM.

The display device DD may have a rectangular shape having a short side in a first direction DR1 and a long side in a second direction DR2 crossing the first direction DR1. However, the invention is not limited to the shape of the display device DD. In other exemplary embodiments, the display device DD may have various shapes, for example.

In an exemplary embodiment, the display device DD may include large-sized display devices such as televisions and monitors and small and middle-sized display devices such as mobile phones, tablet personal computers ("PCs"), navigation units for vehicles, and game consoles. However, these are merely examples, and other electronic devices are adaptable without departing from the concept of the invention.

Hereinafter, a direction that crosses a plane defined by the first and second directions DR1 and DR2 in a substantially perpendicular manner is defined as a third direction DR3. In this specification, an expression of "a plan view" may represent a view in the third direction DR3.

In a plan view, the display device DD includes a display area DA on which an image is displayed and a bezel area BZA disposed adjacent to the display area DA. The bezel area BZA, on which an image is not displayed, may be a portion of the case CS. In an exemplary embodiment, the display device DD may include a partially curved shape. As a result, one area of the display area DA may have a curved shape.

The display area DA may be an area on which an image IM is displayed, and a user views the image IM through the display area DA. The display area DA may have a rectangular shape. The display device DD may display a three-dimensional ("3D") image.

The non-display area NDA (refer to FIG. 15) is an area, which is adjacent to the display area DA and on which the image IM is not displayed. The non-display area NDA may define the bezel area BZA of the display device DD.

The display device DD in an exemplary embodiment of the invention may detect a user's input applied from the outside. In an exemplary embodiment, the user's input includes various types of external inputs such as a portion of a user's body, light, heat, or pressure, for example. Also, the user's input may include an input using a tool such as a touch pen and a stylus pen. Also, the display device DD may detect the user's input applied to a side surface or a rear surface of the display device DD according to a structure of the display device DD. However, the invention is not limited thereto.

Figure 2:
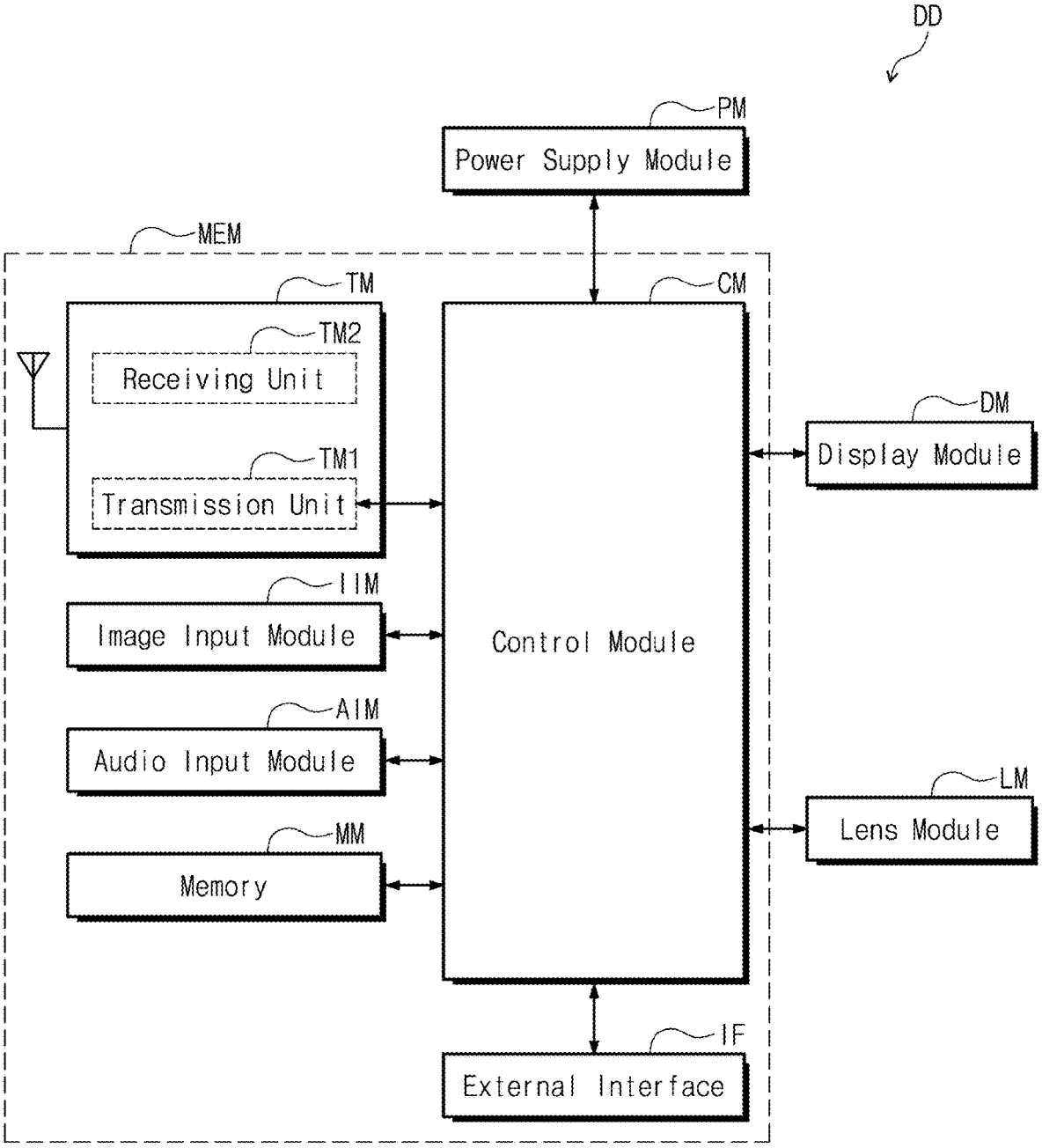
FIG. 2 is a block diagram illustrating the display device in FIG. 1.

FIG. 2 is a block diagram illustrating the display device in FIG. 1.

Referring to FIG. 2, the display device DD may include a display module DM, a power supply module PM, a main electronic module MEM, and a lens module LM. The display module DM, the power supply module PM, the main electronic module MEM, and the lens module LM may be electrically connected to each other.

The power supply module PM provides a power necessary for an overall operation of the display device DD. The power supply module PM may include a typical battery module.

The main electronic module MEM includes various functional modules for operating the display device DD. The main electronic module MEM may be directly disposed (e.g., mounted) on the circuit board, which is electrically connected to the display module DM, or disposed (e.g., mounted) on a separate substrate and connected to the display module DM through a connector (not shown).

The main electronic module MEM may include a control module CM, a wireless communication module TM, an image input module IIM, an audio input module AIM, a memory MM, and an external interface IF. The control module CM controls an overall operation of the display device DD. In an exemplary embodiment, the control module CM may be a microprocessor, for example. In an exemplary embodiment, the control module CM activates or deactivates the display module DM, for example. The control module CM may control other modules such as the image input module IIM or the audio input module AIM.

Although not shown in the drawing, in an exemplary embodiment, the main electronic module MEM may further include a gyroscope sensor, for example. The control module CM may determine an image display mode of the display device DD as one of a first display mode and a second display mode on the basis of a detected signal from the gyroscope sensor, and correspondingly control the display module DM and the lens module LM.

In another exemplary embodiment, the control module CM may determine the image display mode of the display device DD as one of the first display mode and the second display mode on the basis of a selective signal received from a user or an application program, and correspondingly control the display module DM and the lens module LM.

In an exemplary embodiment, the wireless communication module TM transmits/receives a wireless signal to/from another terminal by Bluetooth or WiFi link, for example. The wireless communication module TM may transmit/receive an audio signal using a general communication line. The wireless communication module TM includes a transmission unit TM1 modulating a signal to be transmitted and transmitting the modulated signal and a receiving unit TM2 demodulating a received signal.

The image input module IIM processes an image signal and converts the image signal into image data that are displayable on the display module DM. The audio input module AIM receives an external audio signal through a microphone in a recording mode or a voice recognition mode and converts the received audio signal into electrical voice data.

In an exemplary embodiment, an external interface IF serves as an interface connected to an external charger, a wire/wireless data port, a card socket (e.g., a memory card and SIM/UIM card), etc., for example.

The lens module LM may include a rollable lens and physical/electrical components for sliding and/or rolling the rollable lens in the case CS (refer to FIG. 1). The lens module LM will be described later.

Figure 3A:
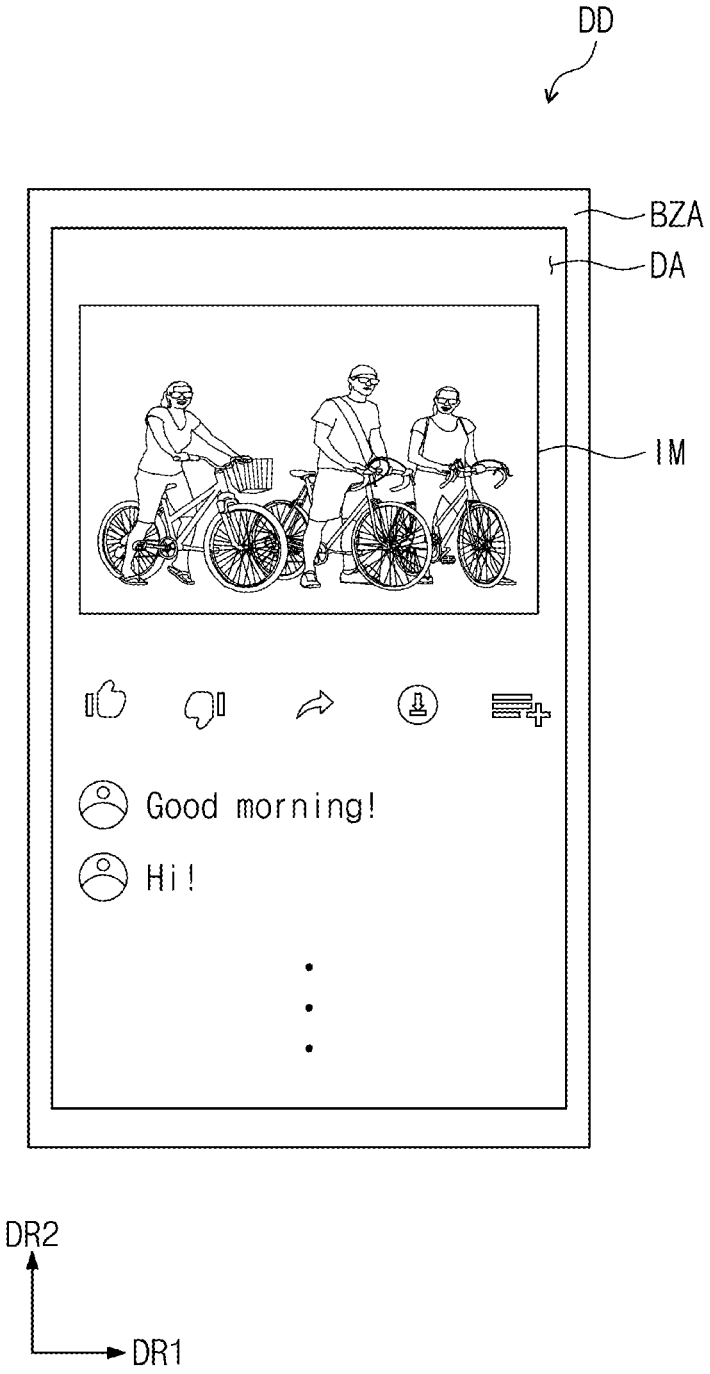
FIG. 3A is a view exemplarily illustrating the display device operating in a first display mode.

FIG. 3A is a view exemplarily illustrating the display device operating in the first display mode.

Referring to FIG. 3A, the display device DD outputs the image IM in a vertical direction (or a perpendicular direction) of the display area DA in the first display mode. In a plan view, the vertical direction is defined such that short sides of the display device DD are disposed at upper and lower sides of the image IM, respectively, and long sides of the display device DD are disposed at left and right sides of the image IM, respectively.

Figure 3B:
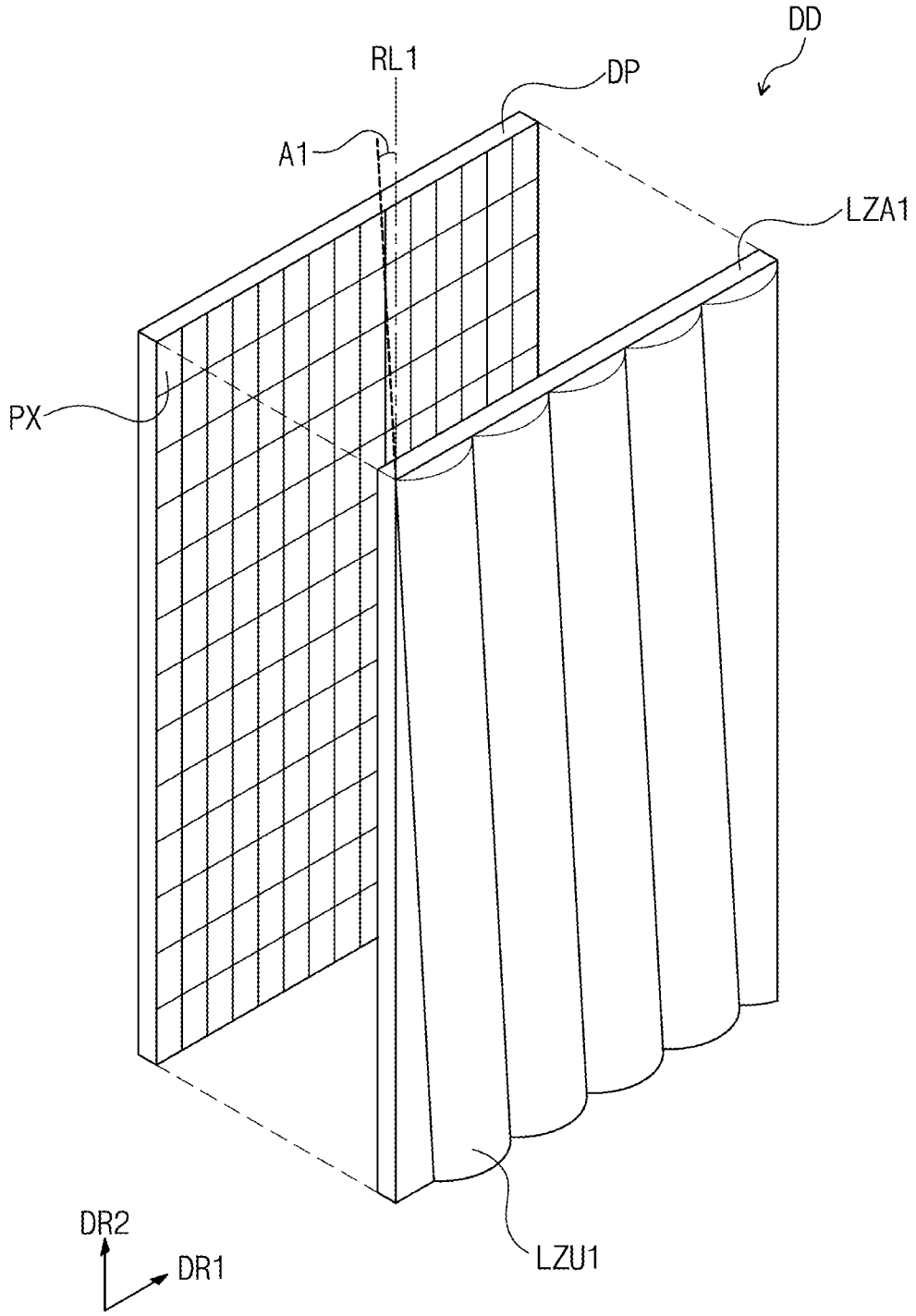
FIG. 3B is a schematic exploded perspective view illustrating a first lens array and a display panel of the display device operating in the first display mode.

FIG. 3B is a schematic exploded perspective view illustrating a first lens array and the display panel of the display device operating in the first display mode.

Referring to FIG. 3B, the display panel DP may include a plurality of pixels PX. The plurality of pixels PX may include, e.g., a first type pixel, a second type pixel, and a third type pixel. In an exemplary embodiment, the first type pixel may emit red light, the second type pixel may emit green light, and the third type pixel may emit blue light, for example. However, the invention is not limited threreto, and the first to third type pixels may emit different color lights. The pixels PX may be arranged in a matrix form in the first direction and the second direction DR2 that is substantially perpendicular to the first direction DR1. In an exemplary embodiment, the display panel DP may be a plasma display panel, a liquid crystal display panel, or an organic light emitting display panel, for example. A first lens array LZA1 may be disposed on a first surface of the display panel DP. In an exemplary embodiment, the first lens array LZA1 may be disposed on a top surface of the display panel DP. That is, the first lens array LZA1 may be disposed adjacent to a surface, through which light is outputted, of the display panel DP.

The first lens array LZA1 may include a plurality of first lens units LZU1 arranged in the first direction DR1. Each of the plurality of first lens units LZU1 may be a lenticular lens. The first lens array LZA1 using the lenticular lens adopts a diagonal arrangement method by which each of the plurality of first lens units LZU1 is inclined by a predetermined angle to compensate resolution reduction in the second direction DR2. In an exemplary embodiment, each of the plurality of first lens units LZU1 may have a shape inclined at a first inclination angle A1 with respect to a first reference line RL1, for example. The first reference line RL1 may be a virtual line parallel to the second direction DR2 perpendicularly crossing the first direction DR1.

The first inclination angle A1 may be determined in consideration of a pitch in the first direction DR1 between the pixels PX, and a pitch in the second direction DR2 between the pixels PX, and a pitch between the plurality of first lens units LZU1.

The display panel DP of the display device DD in FIGS. 3A and 3B outputs an image signal appropriately to the vertical direction (or the perpendicular direction) of the display area DA in the first display mode. The image signal outputted from the display panel DP may pass through the first lens array LZA1 and be provided to the user as a 3D image.

Although the user moves the display device DD in FIGS. 3A and 3B in a horizontal direction, and the display panel DP outputs the image signal appropriately to a horizontal direction (or a transverse direction), the image signal transmitted through the first lens array LZA1 may not be recognized as a 3D image to the user.

Figure 4A:
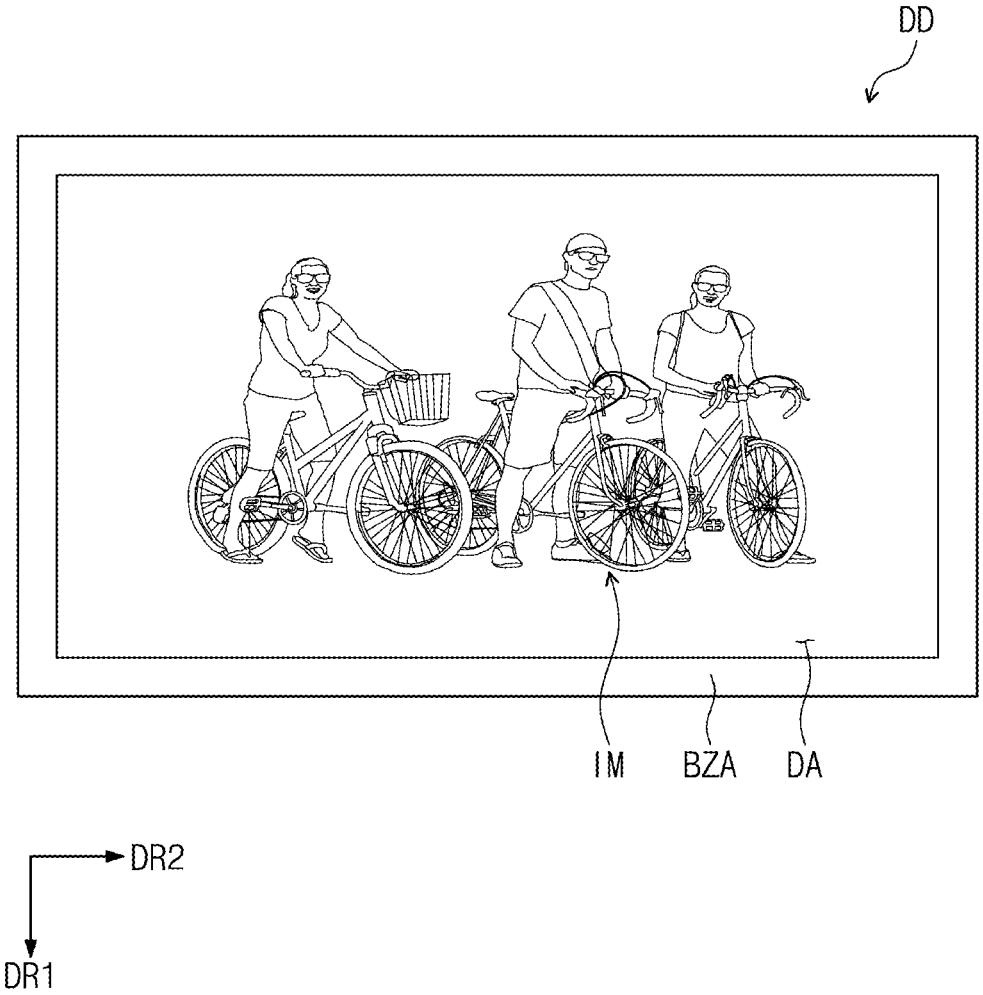
FIG. 4A is a view exemplarily illustrating the display device operating in a second display mode.

FIG. 4A is a view exemplarily illustrating the display device operating in the second display mode.

Referring to FIG. 4A, the display device DD outputs the image IM in a horizontal direction (or a transverse direction) of the display area DA in the second display mode. In a plan view, the horizontal direction is defined such that the short sides of the display device DD are disposed at the left and right sides of the image IM, respectively, and the long sides of the display device DD are disposed at the upper and lower sides of the image IM, respectively.

Figure 4B:
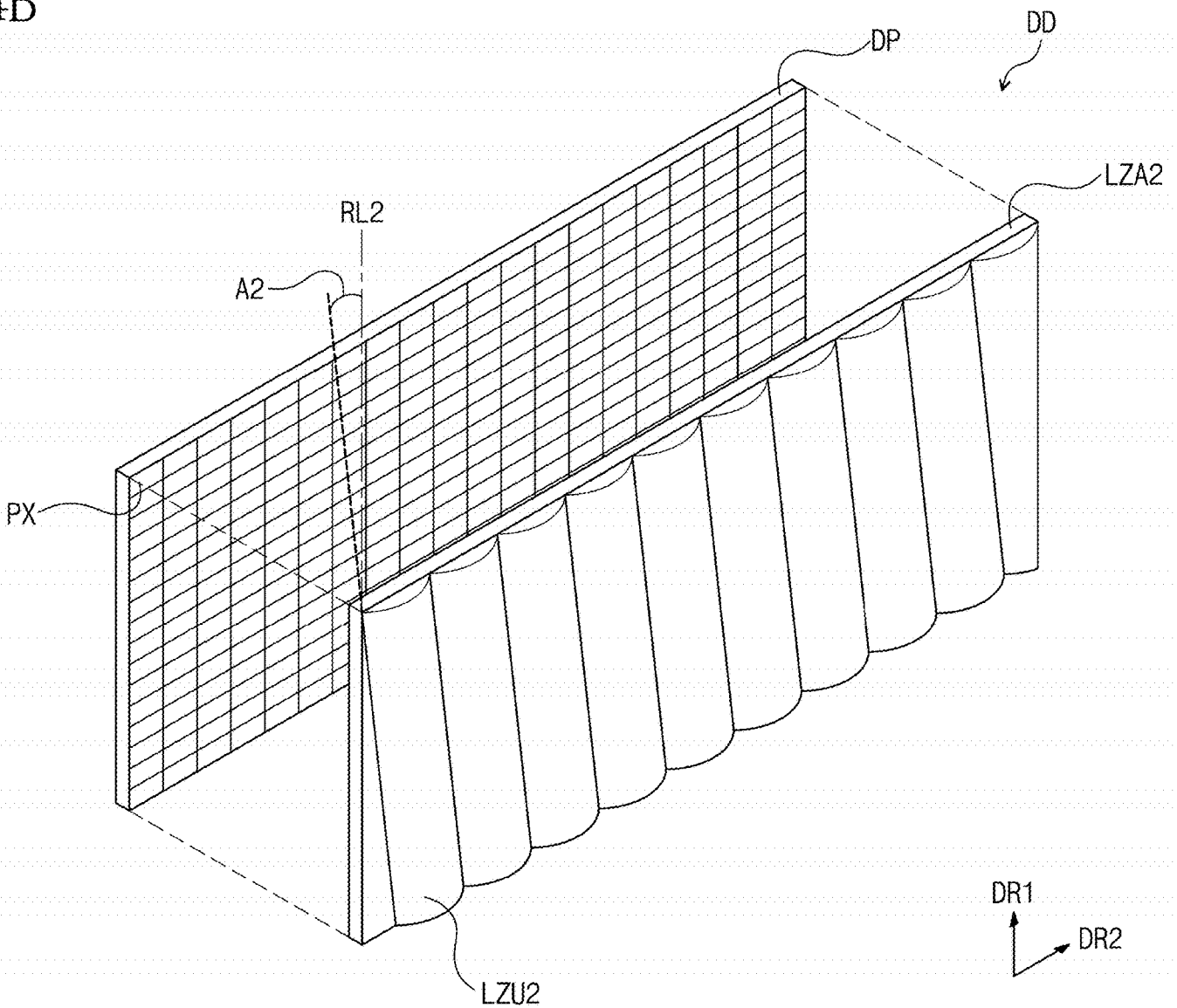
FIG. 4B is a schematic exploded perspective view illustrating a second lens array and the display panel of the display device operating in the second display mode.

FIG. 4B is a schematic exploded perspective view illustrating a second lens array and the display panel of the display device operating in the second display mode. The display panel DP in FIG. 4B is the same as the display panel DP in FIG. 3B except for an arrangement direction.

Referring to FIG. 4B, a second lens array LZA2 may be disposed on a first surface of the display panel DP. In an exemplary embodiment, the second lens array LZA2 may be disposed on the top surface of the display panel DP. That is, the second lens array LZA2 may be disposed adjacent to the surface, through which light is outputted, of the display panel DP.

The second lens array LZA2 may include a plurality of second lens units LZU2 arranged in the second direction DR2. Each of the plurality of second lens units LZU2 may be a lenticular lens. The second lens array LZA2 using the lenticular lens adopts a diagonal arrangement method by which each of the plurality of second lens units LZU2 is inclined by a predetermined angle to compensate resolution reduction in the first direction DR1. In an exemplary embodiment, each of the plurality of second lens units LZU2 may have a shape inclined at a second inclination angle A2 with respect to a second reference line RL2, for example. The second reference line RL2 may be a virtual line parallel to the first direction DR1 perpendicularly crossing the second direction DR2.

The second inclination angle A2 may be determined in consideration of a pitch in the first direction DR1 between the pixels PX, and a pitch in the second direction DR2 between the pixels PX, and a pitch between the plurality of second lens units LZU2. The second inclination angle A2 may be the same as or different from the first inclination angle A1.

The display panel DP of the display device DD in FIGS. 4A and 4B outputs an image signal appropriately to the horizontal direction (or the transverse direction) of the display area DA in the second display mode. The image signal outputted from the display panel DP may pass through the second lens array LZA2 and be provided to the user as a 3D image.

Although the user moves the display device DD in FIGS. 4A and 4B in a vertical direction, and the display panel DP outputs the image signal appropriately to the vertical direction (or the perpendicular direction), the image signal transmitted through the second lens array LZA2 may not be recognized as a 3D image to the user.

As illustrated in FIGS. 3B and 4B, one of the first lens array LZA1 and the second lens array LZA2 may be selectively used according to the arrangement direction of the display panel DP, i.e., the image display mode. In the display device in an exemplary embodiment of the invention, one of the first lens array LZA1 and the second lens array LZA2 may be disposed on the top surface of the display panel according to the image display mode.

Figure 5:
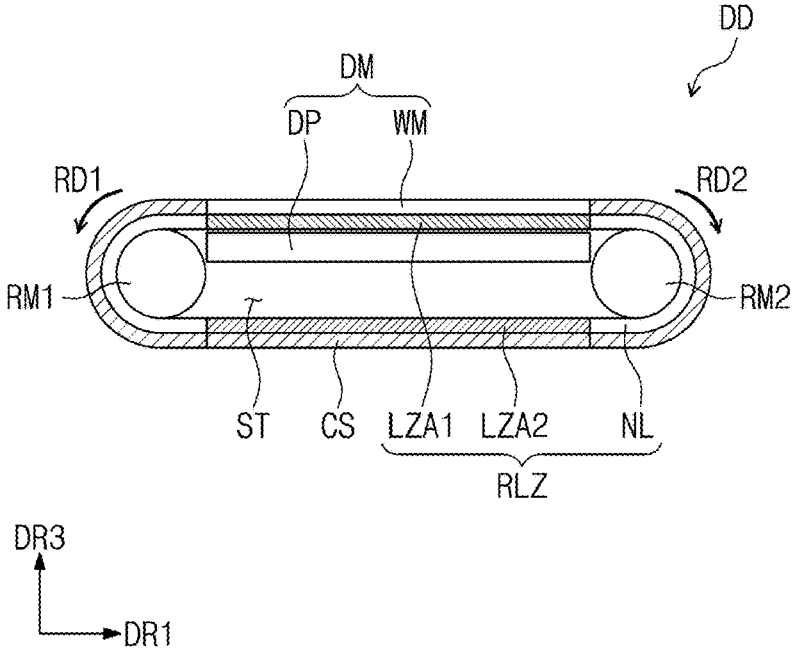
FIGS. 5 and 6 are cross-sectional views taken along line I-I' of the display device in FIG. 1.
Figure 6:
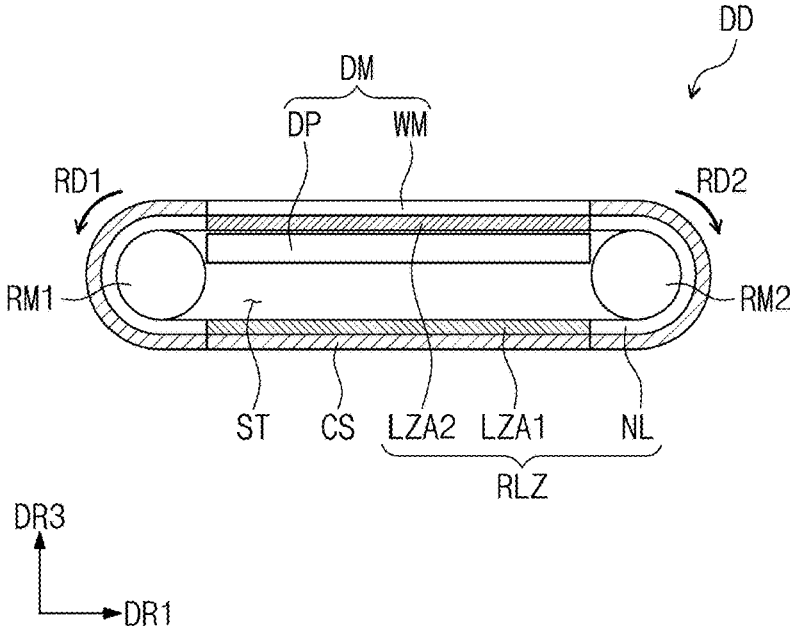

FIGS. 5 and 6 are cross-sectional views taken along line I-I' of the display device in FIG. 1.

Referring to FIGS. 5 and 6, the display device DD includes a display module DM, a rollable lens RLZ, a case CS, and a roller. The display module DM may include a display panel DP and a window module WM. The roller may include a first roller RM1 and a second roller RM2.

The display panel DP may be an organic light emitting display panel. However, the invention is not limited thereto. In other exemplary embodiments, various display panels, which are capable of displaying an image, such as a liquid crystal display panel, an electrowetting display panel, and an electrophoretic display panel may be used as the display panel DP, for example. The display panel DP may be a flexible display panel. Although not shown in the drawing, the display panel DP may include a substrate, a pixel layer disposed on the substrate, and a thin-film encapsulation layer disposed on the substrate to cover the pixel layer.

The display panel DP may be disposed in an accommodation space ST between the first roller RM1 and the second roller RM2. Although not shown in the drawing, the power supply module PM and the main electronic module MEM in FIG. 2 may be disposed in the accommodation space ST. Also, although not shown in the drawing, a supporting member for fixing the display panel DP or the like may be further provided in the accommodation space ST.

The lens module LM in FIG. 2 may include a rollable lens RLZ and first and second rollers RM1 and RM2 for moving the rollable lens RLZ.

The first roller RM1 and the second roller RM2 may be spaced apart from each other in the first direction DR1 inside the rollable lens RLZ. Although not shown in the drawing, the first roller RM1 and the second roller RM2 may rotate by a bearing. The first roller RM1 and the second roller RM2 may be coated with an adhesive layer (not shown) having a weak adhesive function to closely contact the inside of the rollable lens RLZ. Thus, the first roller RM1 and the second roller RM2 may move the rollable lens RLZ while rotating in one of a first rotation direction RD1 (or a counter clockwise direction) and a second rotation direction RD2 (or a clockwise direction). In an exemplary embodiment, although the first roller RM1 and the second roller RM2 may move in both the first rotation direction RD1 and the second rotation direction RD2, the invention is not limited thereto. In another exemplary embodiment, the first roller RM1 and the second roller RM2 may rotate in only one of the first rotation direction RD1 and the second rotation direction RD2.

The rollable lens RLZ includes a first lens array LZA1, a second lens array LZA2, and a connection part NL. The connection part NL may be disposed between the first lens array LZA1 and the second lens array LZA2 and include a transparent material.

As illustrated in FIG. 3B, the first lens array LZA1 may include a plurality of first lens units LZU1. Each of the plurality of first lens units LZU1 may have a shape inclined at a first inclination angle A1 with respect to a first reference line RL1. The first reference line RL1 may be a virtual line parallel to the second direction DR2 perpendicularly crossing the first direction DR1. In an exemplary embodiment, the first lens array LZA1 may be a lens suitable to a first display mode in which the display device DD outputs an image in a vertical direction (or a perpendicular direction), for example.

As illustrated in FIG. 4B, the second lens array LZA2 may include a plurality of second lens units LZU2. Each of the plurality of second lens units LZU2 may have a shape inclined at a second inclination angle A2 with respect to a second reference line RL2. The second reference line RL2 may be a virtual line parallel to the first direction DR1 perpendicularly crossing the second direction DR2. In an exemplary embodiment, the second lens array LZA2 may be a lens suitable to a second display mode in which the display device DD outputs an image in a horizontal direction (or a transverse direction), for example.

As illustrated in FIG. 5, in the first display mode, the first roller RM1 and the second roller RM2 may rotate in one of the first rotation direction RD1 and the second rotation direction RD2 to rotate the rollable lens RLZ so that the first lens array LZA1 is disposed on the top surface of the display panel DP.

As illustrated in FIG. 6, in the second display mode, the first roller RM1 and the second roller RM2 may rotate in one of the first rotation direction RD1 and the second rotation direction RD2 to rotate the rollable lens RLZ so that the second lens array LZA2 is disposed on the top surface of the display panel DP.

As illustrated in FIGS. 5 and 6, as one of the first lens array LZA1 and the second lens array LZA2 is disposed on the top surface of the display panel DP according to the image display mode, the user may watch a 3D image regardless of the image display direction of the display device DD.

Figure 7:
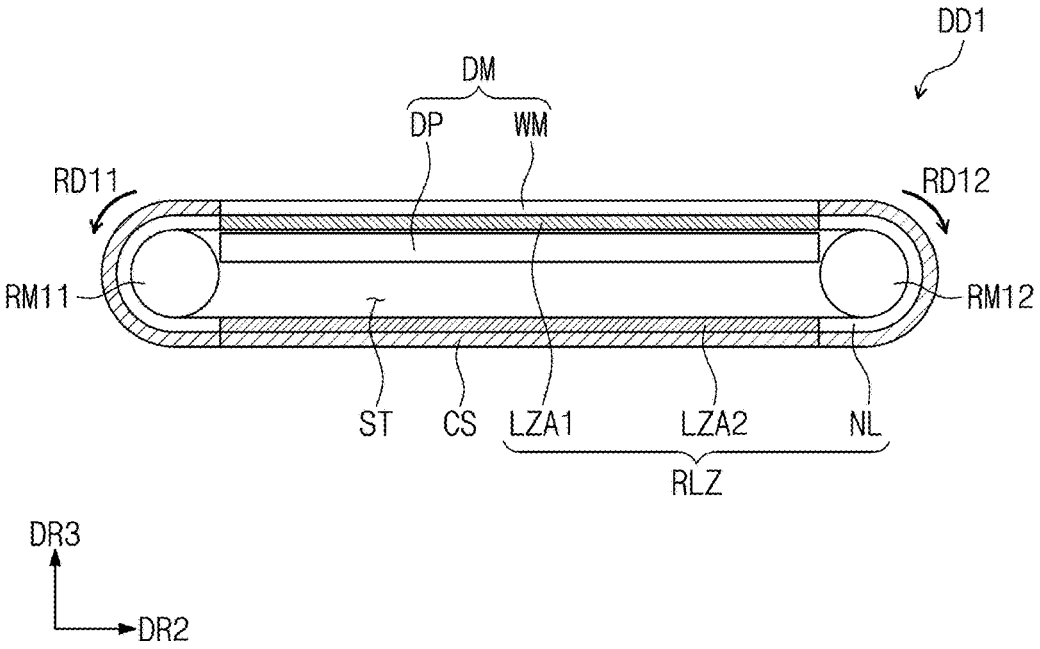
FIGS. 7 and 8 are cross-sectional views illustrating another exemplary embodiment of a display device according to the invention.
Figure 8:
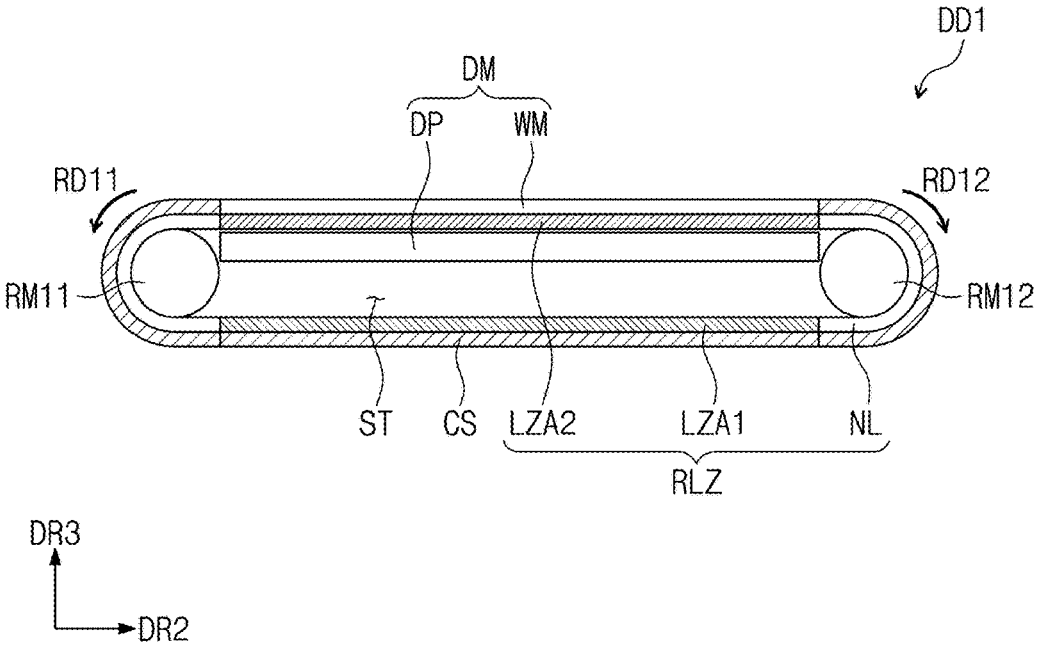

FIGS. 7 and 8 are cross-sectional views illustrating another exemplary embodiment of a display device according to the invention.

Referring to FIGS. 7 and 8, a display device DD1 includes a display module DM, a rollable lens RLZ, a case CS, a first roller RM11, and a second roller RM12. Since the display module DM, the rollable lens RLZ, and the case CS in FIGS. 7 and 8 have the same configuration as the display module DM, the rollable lens RLZ, and the case CS in FIGS. 5 and 6, the same reference symbol will be designated, and overlapped description will be omitted.

The first roller RM1 and the second roller RM2 may be spaced apart from each other in the second direction DR2 inside the rollable lens RLZ. Although not shown in the drawing, the first roller RM1 and the second roller RM2 may rotate by a bearing. The first roller RM1 and the second roller RM2 may be coated with an adhesive layer (not shown) having a weak adhesive function to closely contact the inside of the rollable lens RLZ. Thus, the first roller RM1 and the second roller RM2 may move the rollable lens RLZ while rotating in one of a first rotation direction RD11 (or a counter clockwise direction) and a second rotation direction RD12 (or a clockwise direction). In an exemplary embodiment, although the first roller RM1 and the second roller RM2 may move in both the first rotation direction RD11 and the second rotation direction RD12, the invention is not limited thereto. In another exemplary embodiment, the first roller RM1 and the second roller RM2 may rotate in only one of the first rotation direction RD11 and the second rotation direction RD12.

As illustrated in FIG. 7, in the first display mode, the first roller RM1 and the second roller RM2 may rotate in one of the first rotation direction RD11 and the second rotation direction RD12 to rotate the rollable lens RLZ so that the first lens array LZA1 is disposed on a top surface of the display panel DP.

As illustrated in FIG. 8, in the second display mode, the first roller RM1 and the second roller RM2 may rotate in one of the first rotation direction RD11 and the second rotation direction RD12 to rotate the rollable lens RLZ so that the second lens array LZA2 is disposed on the top surface of the display panel DP.

As illustrated in FIGS. 7 and 8, as one of the first lens array LZA1 and the second lens array LZA2 is disposed on the top surface of the display panel DP according to the image display mode, the user may watch a 3D image regardless of the image display direction of the display device DD1.

In the exemplary embodiment of FIGS. 5 and 6, the first roller RM1 and the second roller RM2 of the display device DD may be spaced apart from each other in the first direction DR1 inside the rollable lens RLZ. In the exemplary embodiment of FIGS. 7 and 8, the first roller RM11 and the second roller RM12 of the display device DD1 may be spaced apart from each other in the second direction DR2 inside the rollable lens RLZ. As described above, the arrangement of the rollers RM1, RM2, RM11, and RM12 and the rotation direction of the rollable lens RLZ may be selectively applied to the display device according to necessity.

Figure 9:
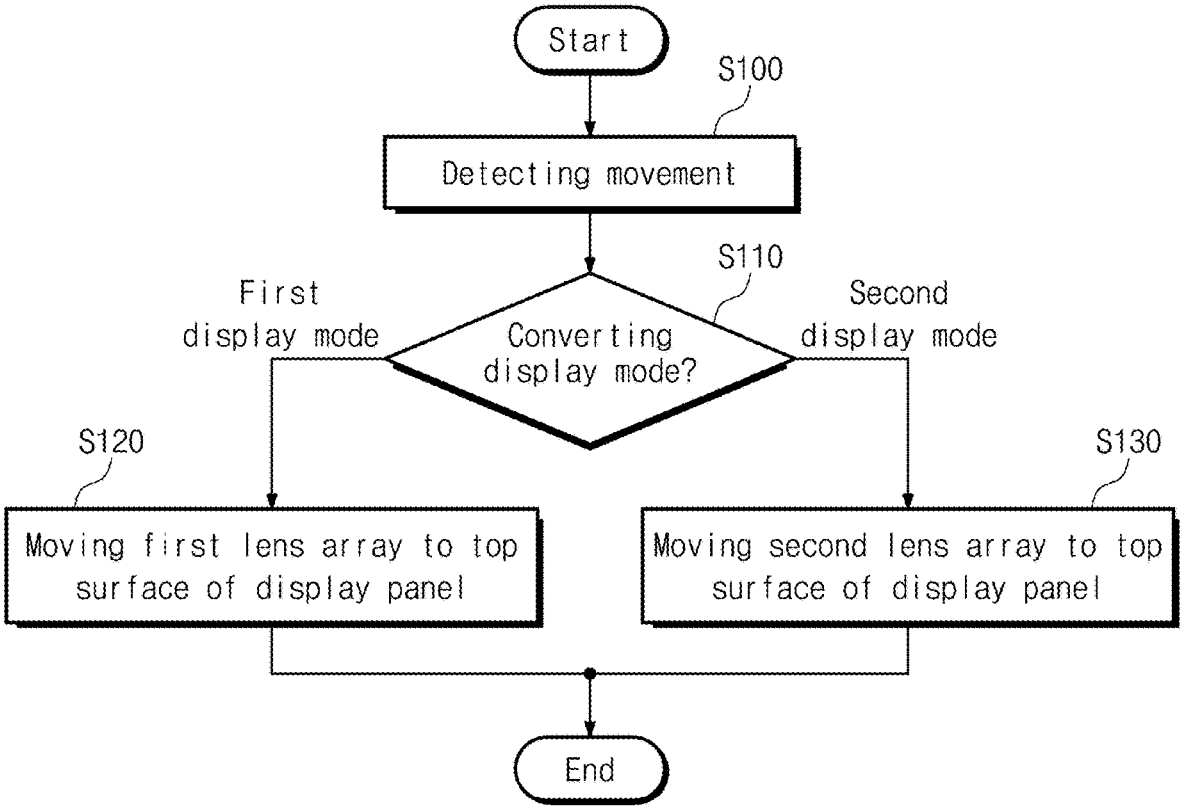
FIG. 9 is a flowchart representing an exemplary embodiment of an operation method of the display device according to the invention.

FIG. 9 is a flowchart representing an exemplary embodiment of an operation method of the display device according to the invention.

Referring to FIGS. 2, 6, and 9, the control module CM detects a movement of the display device DD in operation S100.

The control module CM determines whether the image display mode is changed according to a movement degree of the display device DD by the user in operation S110. In an exemplary embodiment, the control module CM may determine whether the image display mode of the display device DD is changed on the basis of a detected signal from at least one device capable of detecting an angular momentum, a momentum, a movement direction, and a movement distance, such as gyroscope.

The control module CM may determine the image display mode as the first display mode when it is determined that the display device DD moves in a vertical direction (or a perpendicular direction).

In the first display mode, the control module CM controls the first roller RM1 and the second roller RM2 of the lens module LM to rotate the rollable lens RLZ so that the first lens array LZA1 is disposed on the top surface of the display panel DP in operation S120.

The control module CM may determine the image display mode as the second display mode when it is determined that the display device DD moves in a horizontal direction (or a transverse direction).

In the second display mode, the control module CM controls the first roller RM1 and the second roller RM2 of the lens module LM to rotate the rollable lens RLZ so that the second lens array LZA2 is disposed on the top surface of the display panel DP in operation S130.

In another exemplary embodiment, the control module CM may determine the image display mode of the display device DD as one of the first display mode and the second display mode on the basis of a selective signal received from an operation of a physical button/a switch inputted from the user or an application program instead of the movement of the display device DD by the user.

As described above, the control module CM determines the image display mode of the display device DD and controls so that one of the first lens array LZA1 and the second lens array LZA2 is disposed on the top surface of the display panel DP according to the determined image display mode. Thus, the user may watch a 3D image regardless of the screen direction (horizontal or vertical) of the display device.

Figure 10:
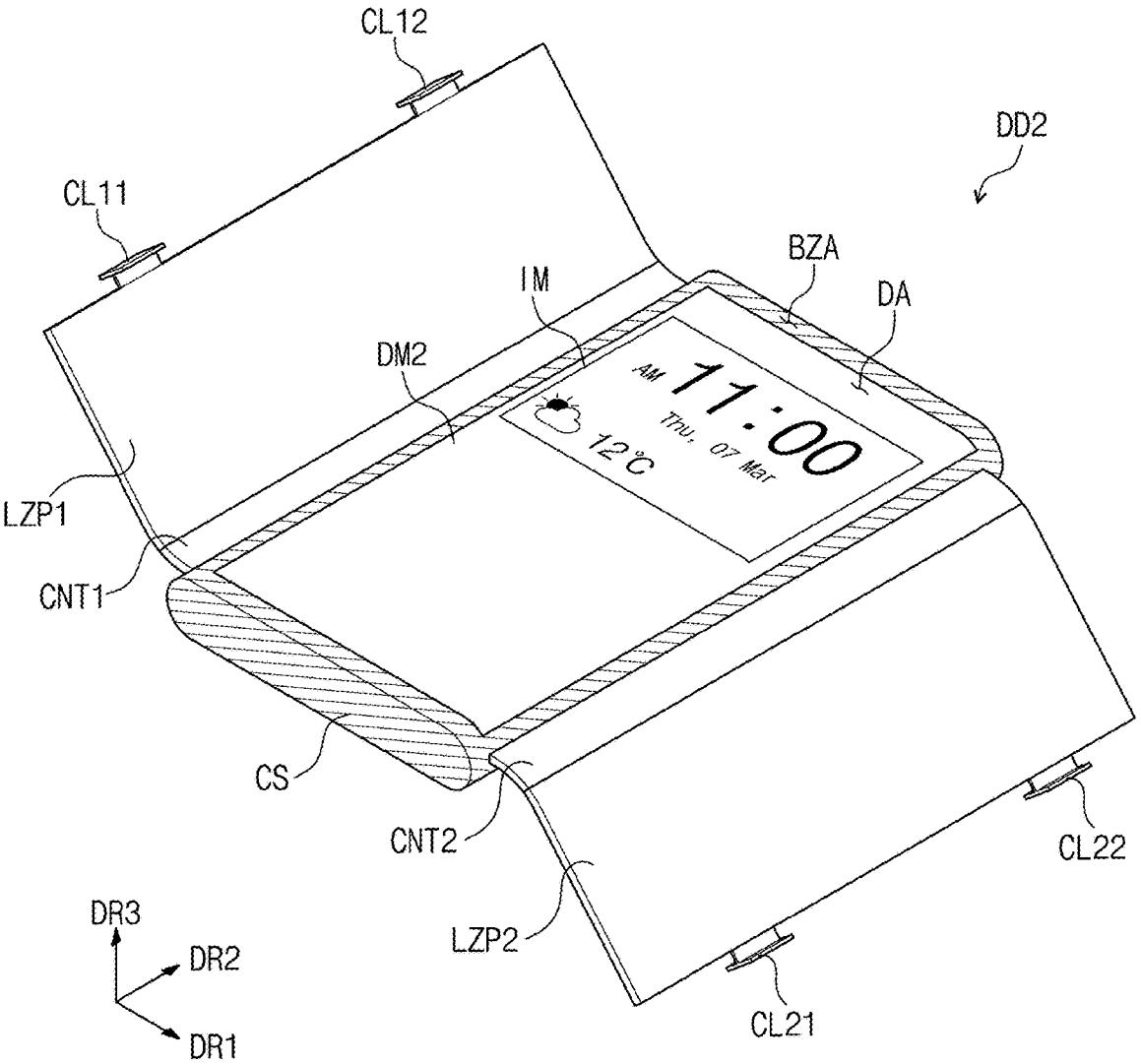
FIG. 10 is a perspective view illustrating another exemplary embodiment of a display device according to the invention.

FIG. 10 is a perspective view illustrating another exemplary embodiment of a display device according to the invention.

Referring to FIG. 10, a display device DD2 may include a display module DM2, a case CS accommodating the display module DM2, a first lens panel LZP1, and a second lens panel LZP2.

The display device DD2 may have a rectangular shape having a short side in a first direction DR1 and a long side in a second direction DR2 crossing the first direction DR1. However, the invention is not limited to the shape of the display device DD2. In other exemplary embodiments, the display device DD2 may have various shapes, for example.

In an exemplary embodiment, the display device DD2 may be a small and middle-sized display device such as mobile phones, tablet PCs, navigation units for vehicles, and game consoles. However, these are merely examples, and other electronic devices are adaptable without departing from the concept of the invention.

In a plan view, the display device DD2 includes a display area DA on which an image is displayed and a bezel area BZA disposed adjacent to the display area DA. The bezel area BZA, on which an image is not displayed, may be a portion of the case CS. In an exemplary embodiment, the display device DD2 may include a partially curved shape. As a result, one area of the display area DA may have a curved shape.

The display device DD2 may further include a first connection part CNT1 and a second connection part CNT2.

The first connection part CNT1 may be attached to one side of the case CS to connect the case CS and the first lens panel LZP1. In another exemplary embodiment, the first connection part CNT1 and the first lens panel LZP1 may be unitary with each other. The first connection part CNT1 may include various materials having a flexible or bendable feature so that the first lens panel LZP1 moves to be disposed on a front surface or a rear surface of the display device DD2.

The second connection part CNT2 may be attached to the other side of the case CS to connect the case CS and the second lens panel LZP2. In another exemplary embodiment, the second connection part CNT2 and the second lens panel LZP2 may be unitary with each other. The second connection part CNT2 may include various materials having a flexible or bendable feature so that the second lens panel LZP2 moves to be disposed on the front surface or the rear surface of the display device DD2.

Although it is illustrated in the exemplary embodiment of FIG. 10 that the first lens panel LZP1 is connected to one of long sides of the display device DD2 through the first connection part CNT1, and the second lens panel LZP2 is connected to the other of the long sides of the display device DD2 through the second connection part CNT2, the invention is not limited thereto. In another exemplary embodiment, the first lens panel LZP1 and the second lens panel LZP2 may be connected to short sides of the display device DD2, respectively.

Each of the first lens panel LZP1 and the second lens panel LZP2 may have a size greater than or equal to a size of the display area DA. The first lens panel LZP1 may include the first lens array LZA1 in FIG. 3B. The second lens panel LZP2 may include the second lens array LZA2 in FIG. 4B.

The display device DD2 may include at least one coupling member for coupling and/or fixing the first lens panel LZP1 to the case CS when the first lens panel LZP1 is disposed on the front surface or the rear surface of the display device DD2. In an exemplary embodiment, although the first lens panel LZP1 includes clips CL11 and CL12 as the coupling member, the invention is not limited thereto.

The display device DD2 may include at least one coupling member for coupling and/or fixing the second lens panel LZP2 to the case CS when the second lens panel LZP2 is disposed on the front surface or the rear surface of the display device DD2. In an exemplary embodiment, although the second lens panel LZP2 includes clips CL21 and CL22 as the coupling member, the invention is not limited thereto.

Figure 11:
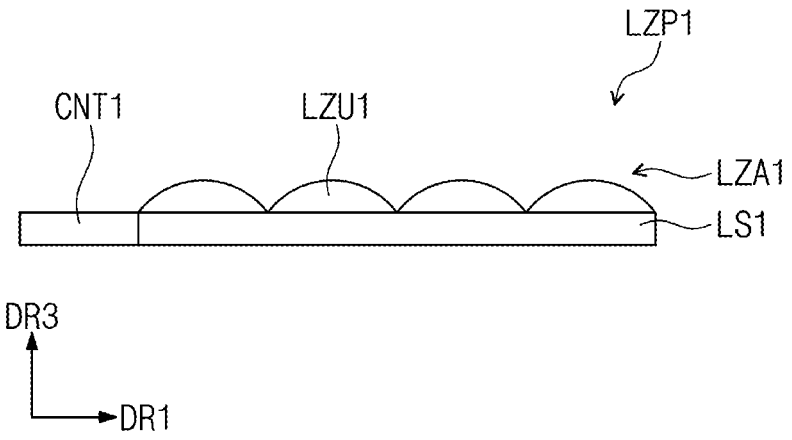
FIG. 11 is a view exemplarily illustrating a cross-section of a first lens panel.

FIG. 11 is a view exemplarily illustrating a cross-section of the first lens panel LZP1.

Referring to FIG. 11, the first lens panel LZP1 includes a first lens array LZA1 and a first lens substrate LS1. The first lens array LZA1 may include a plurality of first lens units LZU1 arranged in the first direction DR1. As illustrated in FIG. 3B, the first lens array LZA1 may include the plurality of first lens units LZU1 inclined at a first angle A1 with respect to a first reference line RL1.

The first lens substrate LS1 may include a rigid plastic substrate as a transparent substrate. The first lens substrate LS1 may preferably include a material that does not refract light generated from a display module DM2 (refer to FIG. 10). The first lens substrate LS1 may protect the first lens array LZA1 from an external impact.

Figure 12:
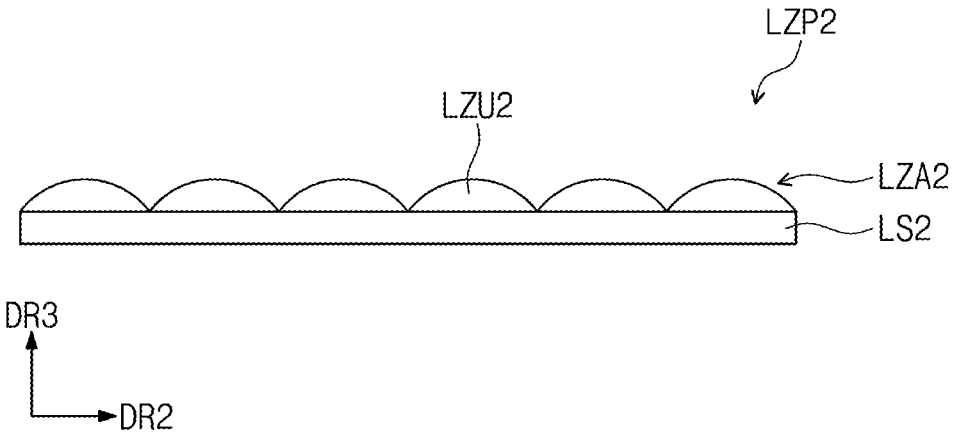
FIG. 12 is a view exemplarily illustrating a cross-section of a second lens panel.

FIG. 12 is a view exemplarily illustrating a cross-section of the second lens panel LZP2.

Referring to FIG. 12, the second lens panel LZP2 includes a second lens array LZA2 and a second lens substrate LS2. The second lens array LZA2 may include a plurality of second lens units LZU2 arranged in the second direction DR2. As illustrated in FIG. 4B, the second lens array LZA2 may include the plurality of second lens units LZU2 inclined at a second angle A2 with respect to a second reference line RL2.

The second lens substrate LS2 may include a rigid plastic substrate as a transparent substrate. The second lens substrate LS2 may preferably include a material that does not refract light generated from the display module DM2 (refer to FIG. 11). The second lens substrate LS2 may protect the second lens array LZA2 from an external impact.

Figure 13:
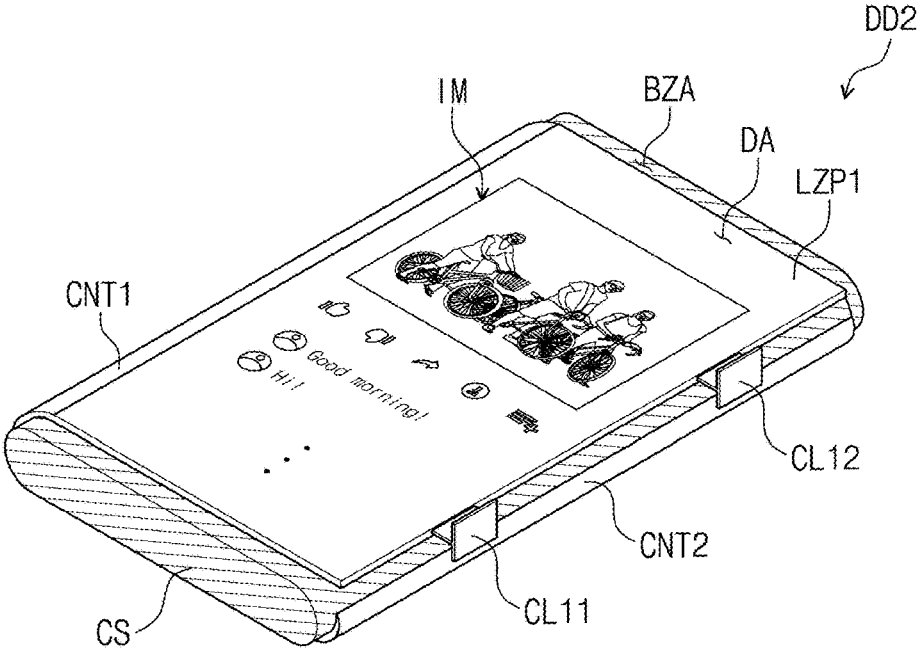
FIG. 13 is a view exemplarily illustrating a state in which the first lens panel is disposed on a front surface of the display device, and the second lens panel is disposed on a rear surface of the display device.

FIG. 13 is a view exemplarily illustrating a state in which the first lens panel LZP1 is disposed on the front surface of the display device DD2, and the second lens panel LZP2 is disposed on the rear surface of the display device DD2.

Referring to FIG. 13, the display device DD2 outputs the image IM in the vertical direction (or perpendicular direction) of the display area DA in the first display mode.

As the first lens panel LZP1 is disposed on the front surface of the display device DD2, and the second lens panel LZP2 is disposed on the rear surface of the display device DD2 in the first display mode, the user may watch the 3D image IM.

The first lens panel LZP1 may be disposed on the front surface of the display device DD2 and then the clips CL11 and CL12 may be coupled to a right long side of the case CS. The first lens panel LZP1 may be fixed to the front surface of the display device DD2 by the clips CL11 and CL12.

Although not shown in the drawing, the second lens panel LZP2 may be disposed on the rear surface of the display device DD2 and then the clips CL21 and CL22 (refer to FIG. 10) may be coupled to a left long side of the case CS. The second lens panel LZP2 may be fixed to the rear surface of the display device DD2 by the clips CL21 and CL22.

Figure 14:
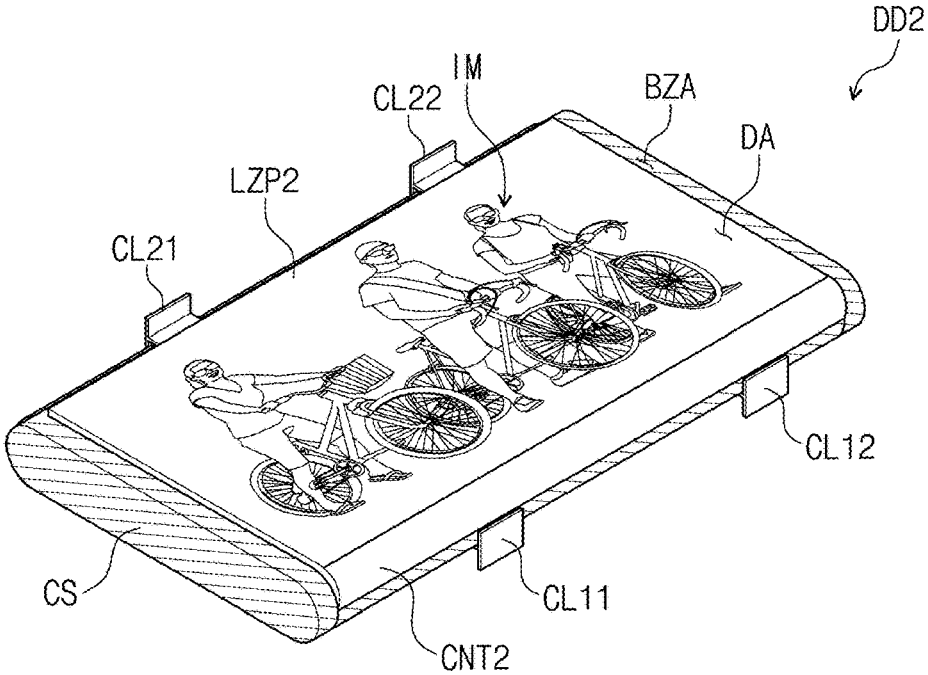
FIG. 14 is a view exemplarily illustrating a state in which the first lens panel is disposed on the rear surface of the display device, and the second lens panel is disposed on the front surface of the display device.

FIG. 14 is a view exemplarily illustrating a state in which the first lens panel LZP1 is disposed on the rear surface of the display device DD2, and the second lens panel LZP2 is disposed on the front surface of the display device DD2.

Referring to FIG. 14, the display device DD2 outputs the image IM in the horizontal direction (or transverse direction) of the display area DA in the second display mode.

As the first lens panel LZP1 is disposed on the rear surface of the display device DD2, and the second lens panel LZP2 is disposed on the front surface of the display device DD2 in the second display mode, the user may watch the 3D image IM.

The first lens panel LZP1 may be disposed on the rear surface of the display device DD2 and then the clips CL11 and CL12 may be coupled to the right long side of the case CS. The first lens panel LZP1 may be fixed to the rear surface of the display device DD2 by the clips CL11 and CL12.

The second lens panel LZP2 may be disposed on the front surface of the display device DD2 and then the clips CL21 and CL22 may be coupled to the left long side of the case CS. The second lens panel LZP2 may be fixed to the front surface of the display device DD2 by the clips CL21 and CL22.

Figure 15:
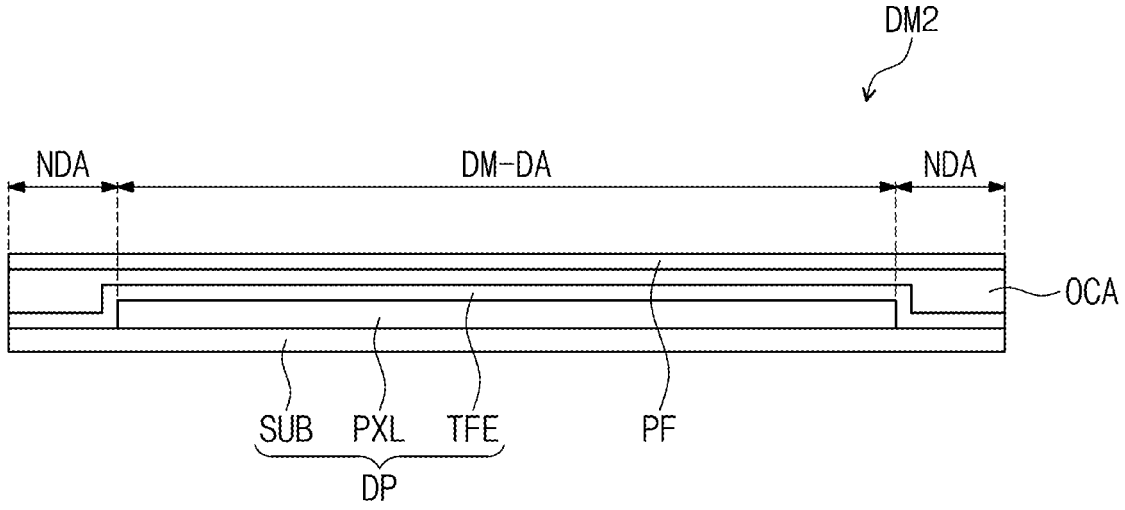
FIG. 15 is a schematic view illustrating a portion of a cross-section of a display module in FIG. 10.

FIG. 15 is a schematic view illustrating a portion of a cross-section of the display module DM2 in FIG. 10.

Referring to FIG. 15, the display module DM2 may include a display panel DP, a protection film PF, and an adhesive layer OCA.

The display panel DP may be an organic light emitting display panel. However, the invention is not limited thereto. In an exemplary embodiment, various display panels capable of displaying an image such as a liquid crystal display panel, an electrowetting display panel, and an electrophoretic display panel may be used as the display panel DP. The display panel DP may be a flexible display panel.

The display panel DP may include a substrate SUB, a pixel layer PXL disposed on the substrate SUB, and a thin-film encapsulation layer TFE disposed on the substrate SUB to cover the pixel layer PXL. The substrate SUB may include a flexible plastic substrate as a transparent substrate. In an exemplary embodiment, the substrate SUB may include polyimide, for example.

The substrate SUB may include a display area DM-DA and a non-display area NDA around the display area DM-DA. The pixel layer PXL may be disposed on the display area DM-DA. The pixel layer PXL may include a plurality of pixels, and each of the pixels may include a light emitting element. The display area DM-DA may correspond to the display area DA of the display device DD2 in FIG. 10, and the non-display area NDA may correspond to the bezel area BZA of the display device DD2 in FIG. 10.

The thin-film encapsulation layer TFE may include at least two inorganic layers and an organic layer disposed between the inorganic layers. The inorganic layers may include an inorganic material and protect the pixel layer PXL from moisture/oxygen. The organic layer may include an organic material and protect the pixel layer PXL from foreign substances such as dust particles.

Although not shown in the drawing, a touch sensing unit for detecting an external input (user's hands or a touch pen) may be further provided on the thin-film encapsulation layer TFE. In another exemplary embodiment, the touch sensing part may be manufactured as a touch panel separately from the display panel DP and attached to the display panel DP by an adhesive.

The protection film PF is disposed on the thin-film encapsulation layer TFE. The protection film PF includes a polymer material. The protection film PF may absorb an impact applied from the outside to protect the display panel DP from the impact. The protection film PF may be adhered to the top surface of the display panel DP through the adhesive layer OCA. When the display module further includes the touch sensing unit on the thin-film encapsulation layer TFE, the protection film PF may be disposed on the touch sensing unit. In another exemplary embodiment, the protection film PF may be omitted. The adhesive layer OCA may include an optical clear adhesive. An image generated from the display panel DP may pass through the protection film PF and be provided to the user.

In an exemplary embodiment, the adhesive layer OCA and the protection film PF may preferably include a material that does not refract the light generated from the display panel DP.

Figure 16:
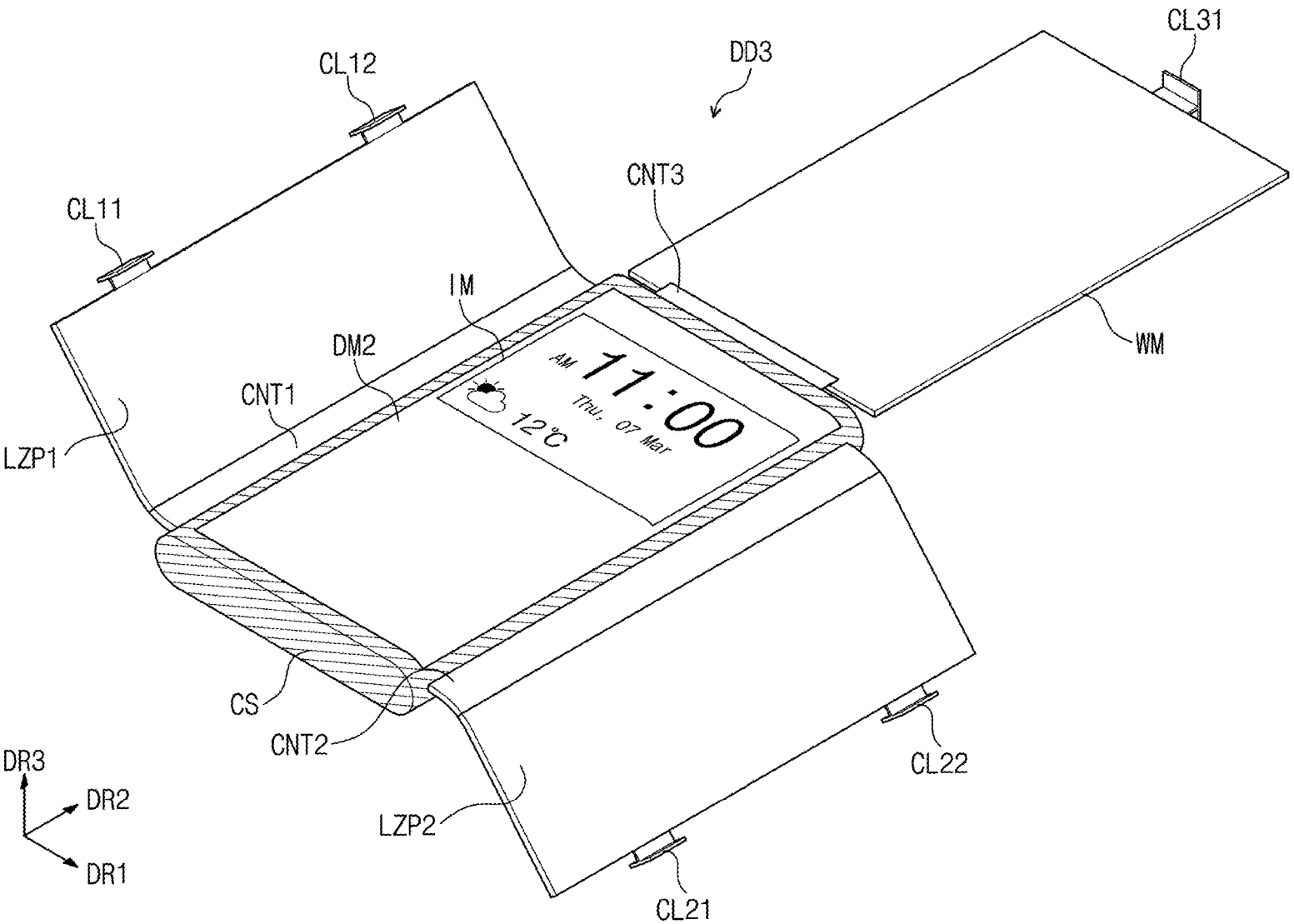
FIG. 16 is a perspective view illustrating another exemplary embodiment of a display device according to the invention.

FIG. 16 is a perspective view illustrating another exemplary embodiment of a display device according to the invention.

Referring to FIG. 16, a display device DD3 has a configuration similar to the display device DD2 in FIG. 10 and further includes a third connection part CNT3, a third clip CL31 and a window module WM.

The window module WM may be connected to a short side of a case CS through the third connection part CNT3. The third connection part CNT3 may include a flexible material. In another exemplary embodiment, the third connection part CNT3 may be unitary with the window module WM. In the illustrated exemplary embodiment, the window module WM is connected to an upper short side of the case CS, but the invention is not limited thereto, and the window module WM may be connected to an lower short side of the case CS, or to both of the upper and lower short sides of the case CS.

The window module WM may protect a display module DM2 from external scratches and impacts. An image generated from the display module DM2 may pass through the window module WM and be provided to the user.

When a display image IM is a two-dimensional image, i.e., in a normal display mode, the window module WM may be disposed on a front surface of the display device DD3, and a first lens panel LZP1 and a second lens panel LZP2 may overlap at a rear surface of the display device DD3.

Figure 17:
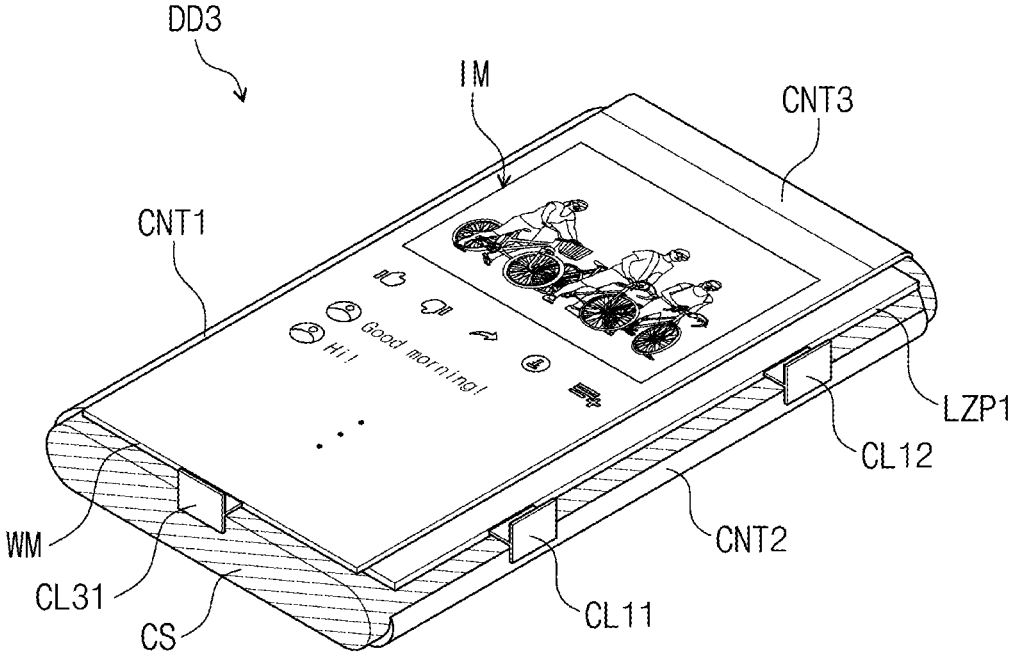
FIG. 17 is a view exemplarily illustrating an arrangement of a first lens panel, a second lens panel, and a window module of the display device in the first display mode.

FIG. 17 is a view exemplarily illustrating an arrangement of the first lens panel LZP1, the second lens panel LZP2, and the window module WM of the display device DD3.

Referring to FIG. 17, as the first lens panel LZP1 is disposed on the front surface of the display device DD3, and the second lens panel LZP2 is disposed on the rear surface of the display device DD3, the user may watch the 3D image IM. Here, the first lens panel LZP1 and the display module DM2 may be protected by disposing the window module WM on a top surface of the first lens panel LZP1. In an exemplary embodiment, the third clip CL31 may be coupled to a lower short side of CS.

Figure 18:
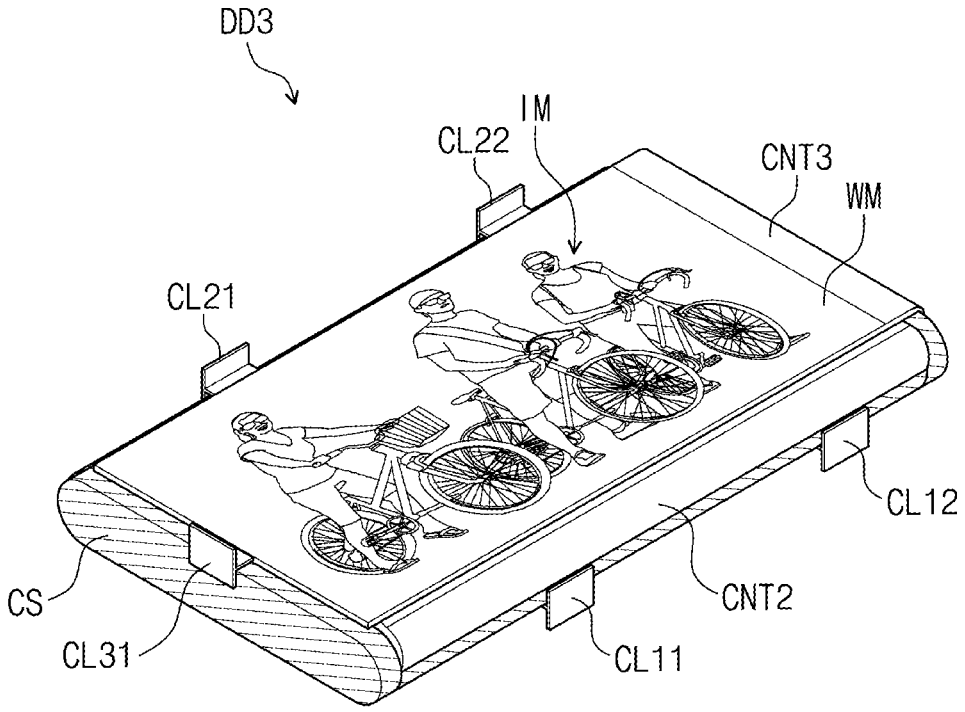
FIG. 18 is a view exemplarily illustrating an arrangement of the first lens panel, the second lens panel, and the window module of the display device in the second display mode.

FIG. 18 is a view exemplarily illustrating an arrangement of the first lens panel LZP1, the second lens panel LZP2, and the window module WM of the display device DD3 in a second display mode.

Referring to FIG. 18, as the first lens panel LZP1 is disposed on the rear surface of the display device DD3, and the second lens panel LZP2 is disposed on the front surface of the display device DD3 in the second display mode, the user may watch the 3D image IM. Here, the second lens panel LZP2 and the display module DM2 may be protected by disposing the window module WM on a top surface of the second lens panel LZP2. In an exemplary embodiment, the third clip CL31 may be coupled to a lower short side of CS.

The display device having the above-described configuration may dispose the first lens array on the top surface of the display panel when the screen direction is the horizontal (transverse) direction and dispose the second lens array on the top surface of the display panel when the screen direction is the vertical (perpendicular) direction. Thus, the display device may display the 3D image regardless of the screen direction.

Although the exemplary embodiments of the invention have been described, it is understood that the invention should not be limited to these exemplary embodiments but various changes and modifications may be made by one ordinary skilled in the art.

Hence, the real protective scope of the invention shall be determined by the technical scope of the accompanying claims.

What is claimed is:

1. A display device comprising:

a display panel which displays an image according to an image display mode including a first display mode and a second display mode, the display panel comprising a surface on which the image is displayed;

a rollable lens comprising a first lens array and a second lens array spaced apart from the first lens array; and a roller disposed inside the rollable lens, wherein the roller rotates the rollable lens so that the first lens array is disposed on the surface of the display panel in the first display mode, and the roller rotates the rollable lens so that the second lens array is disposed on the surface of the display panel in the second display mode.

2. The display device of claim 1, wherein the first display mode outputs the image in a vertical direction of the display panel, and the second display mode outputs the image in a horizontal direction of the display panel.

3. The display device of claim 2, wherein the first lens array comprises a plurality of first lens units arranged in a first direction and the second lens array comprises a plurality of second lens units arranged in a second direction crossing the first direction.

4. The display device of claim 3, wherein the plurality of first lens units has a shape inclined at a first inclination angle with respect to a virtual first reference line parallel to the second direction, and the plurality of second lens units has a shape inclined at a second inclination angle with respect to a virtual second reference line parallel to the first direction.

5. The display device of claim 4, wherein each of the plurality of first lens units and the plurality of second lens units comprise a lenticular lens.

6. The display device of claim 4, wherein the first inclination angle is different from the second inclination angle.

7. The display device of claim 3, wherein the roller comprises a first roller and a second roller, which are spaced apart from each other in the first direction.

8. The display device of claim 7, wherein the first roller and the second roller move the rollable lens in a first rotation direction so that the first lens array is disposed on the surface of the display panel when the image display mode of the display panel is switched from the second display mode to the first display mode, and the first roller and the second roller move the rollable lens in a second rotation direction different from the first rotation direction so that the second lens array is disposed on the surface of the display panel when the image display mode of the display panel is switched from the first display mode to the second display mode.

9. The display device of claim 8, wherein the first roller and the second roller are disposed in correspondence to long sides of the display panel, respectively.

10. The display device of claim 8, wherein the first roller and the second roller are disposed in correspondence to short sides of the display panel, respectively.

11. The display device of claim 8, wherein a size of each of the first lens array and the second lens array is greater than or equal to a size of the display panel.

12. The display device of claim 1, further comprising a window module corresponding to the surface of the display panel and disposed on the rollable lens.

13. The display device of claim 1, further comprising a case which accommodates the rollable lens, the display panel and the roller.

14. A display device comprising:

a display panel which displays an image;

a case which accommodates the display panel;

a first lens panel attached to a first side of the case, the first lens panel comprising a first lens array comprising a plurality of first lens units arranged in a first direction; and a second lens panel attached to a second side of the case, the second lens panel comprising a second lens array comprising a plurality of second lens units arranged in a second direction.

15. The display device of claim 14, further comprising:

a first connection part which connects the case with the first lens panel; and a second connection part which connects the case with the second lens panel.

16. The display device of claim 15, wherein each of the first connection part and the second connection part comprises a flexible material.

17. The display device of claim 14, wherein the plurality of first lens units has a shape inclined at a first inclination angle with respect to a virtual first reference line parallel to the second direction, and the plurality of second lens units has a shape inclined at a second inclination angle with respect to a virtual second reference line parallel to the first direction.

18. The display device of claim 17, wherein the first inclination angle is different from the second inclination angle.

19. The display device of claim 14, wherein each of the plurality of first lens units and the plurality of second lens units comprise a lenticular lens.

20. The display device of claim 14, further comprising a window module attached to a third side of the case.

* * * * *